United States Patent [19]

Jenn et al.

[11] 4,071,738

[45] Jan. 31, 1978

[54] VENTILATED RANGE WITH CONVERTIBLE RADIANT CONVECTION OVEN

[75] Inventors: Louis J. Jenn; Joseph J. Cerola, both of Indianapolis, Ind.

[73] Assignee: Jenn Air Corporation, Indianapolis, Ind.

[21] Appl. No.: 646,906

[22] Filed: Jan. 6, 1976

[51] Int. Cl.[2] ..... F27D 11/02; A21B 1/00

[52] U.S. Cl. ..... 219/400; 126/21 A; 99/340; 99/447; 219/393; 219/408; 219/445; 219/454; 219/476; 219/479

[58] Field of Search ..... 99/340, 446, 447; 126/21 A, 198, 299 B; 219/393, 396, 398, 400, 408, 443, 445, 454, 460, 476, 477, 478, 479, 480

[56] References Cited

U.S. PATENT DOCUMENTS

| | | | |
|---|---|---|---|
| 2,862,095 | 11/1958 | Scofield | 219/400 UX |
| 3,089,479 | 5/1963 | Perl | 126/21 A |
| 3,587,555 | 6/1971 | Cerola | 126/21 A |
| 3,678,245 | 7/1972 | Ackermann | 219/396 |
| 3,780,721 | 12/1973 | Durth | 126/21 A |
| 3,797,375 | 3/1974 | Cerola | 99/340 |
| 3,828,760 | 8/1974 | Farber et al. | 126/21 A |
| 3,884,213 | 5/1975 | Smith | 126/21 A |
| 3,889,100 | 6/1975 | Dills | 219/393 |
| 3,926,171 | 12/1975 | Kurek et al. | 126/21 A |

*Primary Examiner*—Volodymyr Y. Mayewsky
*Attorney, Agent, or Firm*—Woodard, Weikart, Emhardt & Naughton

[57] ABSTRACT

Disclosed is a domestic cooking range of the ventilated type having surface elements and an underlying oven characterized by an extension of the ventilating fan motor shaft carrying an auxiliary fan disposed within the oven which provides forced circulation of air in the oven. The oven may thus be selectively operated in the conventional radiant heating mode or in the forced circulation or "convected" mode depending upon whether the ventilating fan motor is in operation. The oven can be held at an elevated temperature (of the order of 550° F) for a time interval to accelerate catalytic self-cleaning (catalyst added to the porcelain frit covering the oven surface) because of air circulation within the oven door and passages adjacent the door, this cooling air flow being induced by operation of the ventilating fan.

5 Claims, 8 Drawing Figures

VENTILATED RANGE WITH CONVERTIBLE RADIANT CONVECTION OVEN

BACKGROUND OF THE INVENTION

Cooking ranges having ventilated surface units are well known in the prior art. One such range, with interchangeable surface elements, is disclosed in, among others, Cerola U.S. Pat. No. 3,797,375. Convected, or forced circulation ovens are also well known, these having the advantage of more efficient and rapid heat transfer to the food in preparation. This results in substantial energy saving and reduces meat shrinkage. To the present convected ovens have been used in institutional and commercial baking and have not been found in domestic ranges because of the long-established commitment to radiant type ovens and the design difficulty and customer resistance inherent in a change from the long-established radiant oven mode of operation.

The concept of the present invention envisages the adaptation of the ventilated surface unit type of range, disclosed in the patent mentioned above, for convected oven mode of operation. The oven can be operated, if desired, in the conventional radiant mode and, in the preferred form, utilizes the conventional lower oven baking element and the conventional, upper broil element without requiring the addition of special heating elements for the convection mode operation of the oven.

With the additional air passages formed in the oven to provide the convection oven option, and by providing for forced circulation of air within the hollow oven door (as contrasted to thermal convection of cooling air within the oven door), the oven may be operated at elevated temperature (of the order of 550° F) for a time interval without producing an unacceptable temperature rise on the outer surface of the oven door and adjacent frame and top surfaces of the range. This freedom to operate the oven at elevated temperature provides an important advantage. "Catalytic" type self-cleaning ovens have, in the recent past, achieved considerable market acceptance. A catalyst is added to the porcelain frit which covers the interior surface of the oven and, through its action, during normal oven use at normal temperatures, the heat, oxygen and the catalyst combine to remove and oxidize grease and spattered particles from the oven walls during use. The cleaning action occurs while the oven is in regular use and is referred to as "continuous cleaning". It has been found that debris removal performance at normal oven operating temperatures leaves much to be desired. However, if the oven can be safely operated at an elevated, 550° F, temperature for a cleaning cycle time interval of one to three hours, soil removal performance is vastly improved.

The structure of the present invention provides a passage adjacent the upper, insulated surface of the oven which, through apertures adjacent the surface heating elements, communicates with the ventilating plenum and, at the other end of the passage, communicates with apertures which generally register with apertures along the upper margin of the oven door. When the oven door is closed, cooling air is thus drawn through the oven door into the passage above the oven and then into the ventilating plenum. This cooling of the door and range surfaces adjacent the passage limits the temperature rise of these surfaces and permits operation of the oven in a cleaning cycle at high temperature for the desired time interval to provide the enhanced soil removal performance inherent in the high temperature, cleaning cycle operation.

DESCRIPTION OF THE PREFERRED EMBODIMENTS

Figure 1:
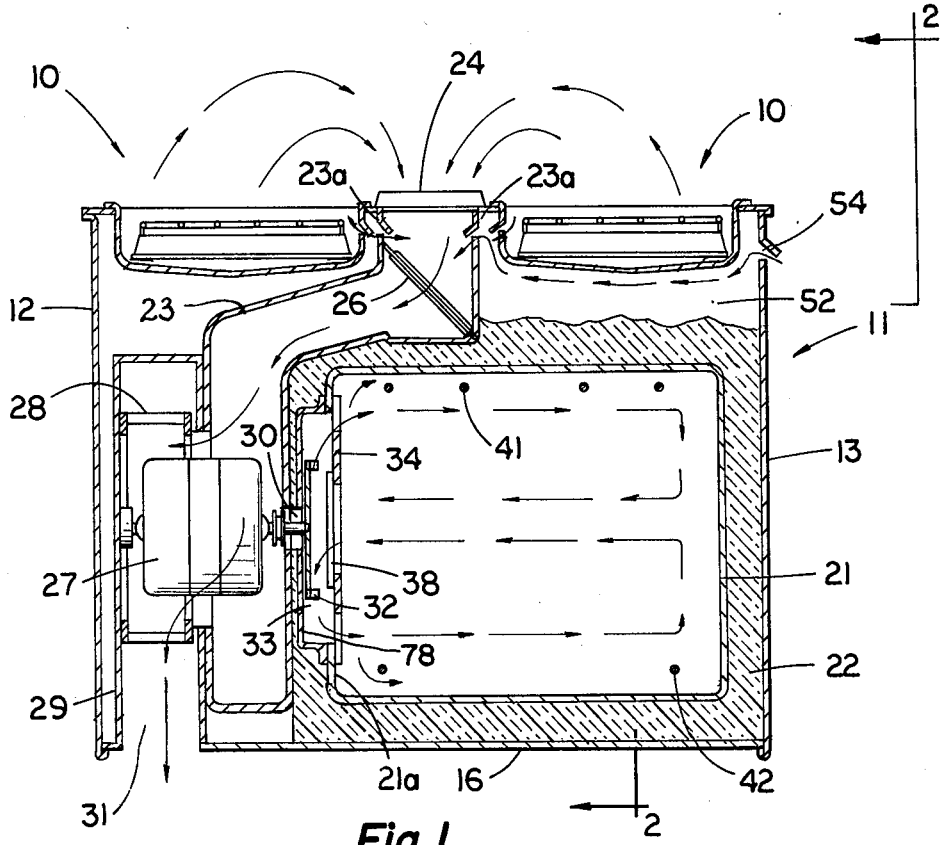
FIG. 1 is a side sectional view of a range embodying the present invention.
Figure 2:
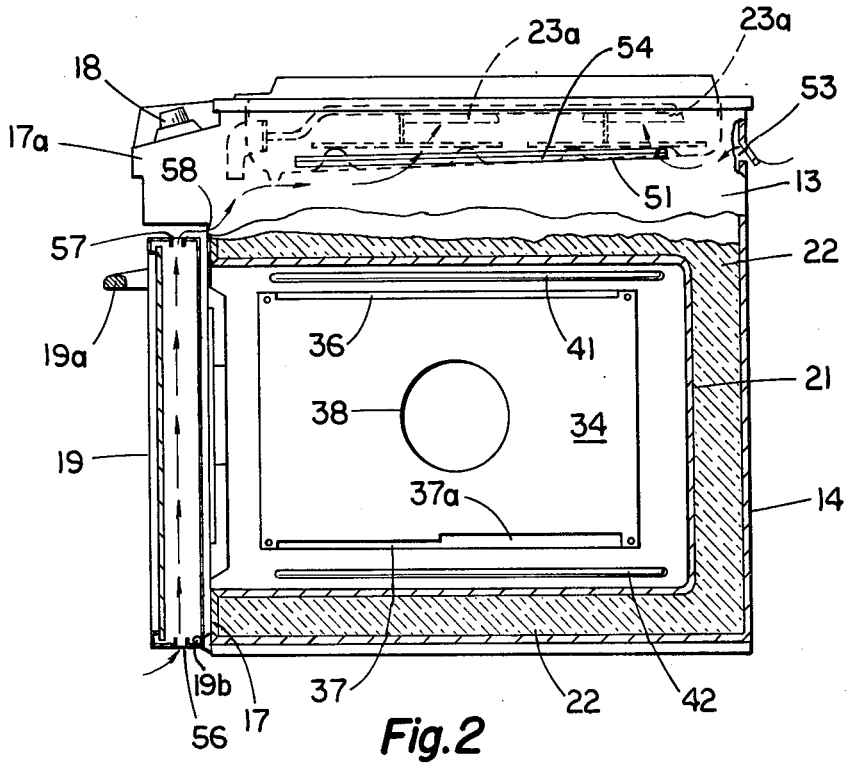
FIG. 2 is a side sectional view taken generally along the line 2—2 of FIG. 1.
Figure 7:
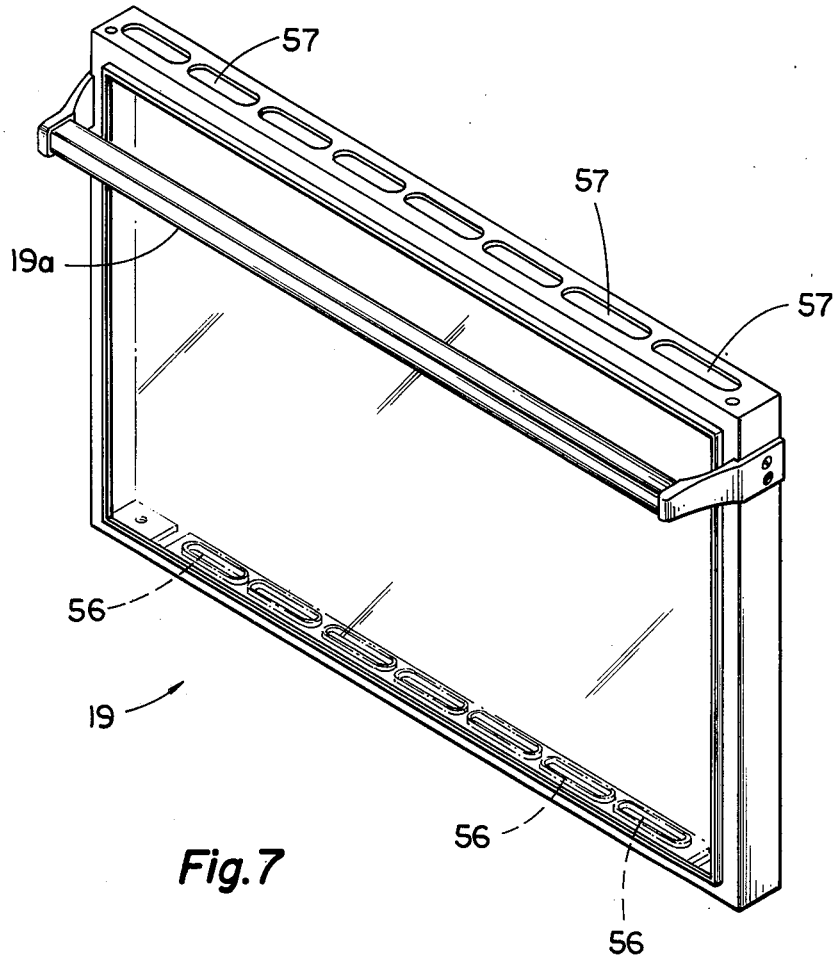
FIG. 7 is a perspective view of the access door for the oven shown in FIGS. 1 and 2.

Referring initially to FIGS. 1 and 2, the range there disclosed includes a housing 11 accomodating upper top cooking elements identified generally at 10 and, underlying these, an insulated oven enclosure 21. The range housing 11 is formed by side panels 12 and 13, rear panels 14 (FIG. 2) and base 16. The oven enclosure is identified at 21 in FIG. 1 and is shown in detail in FIG. 3 as will subsequently be described. The front of the oven enclosure is open and is closed by the oven door 19, having a handle **19*a*. The oven door, as may be seen in FIG. 2 and as described in detail with reference to FIG. 7 is hollow and is hinged along its base at 19*b* to the front panel, generally identified at 17 in FIG. 2, of the range. The front panel is formed to provide an overhang 17*a* which houses the conventional oven controls and controls indicated at 18 for the upper elements 10. Extending generally along one sidewall 21*a* of the oven enclosure is a plenum structure 23. The plenum 23 extends over a portion of the upper wall of the oven enclosure and terminates at an inlet 24. A removable filter 26 may be disposed within the plenum. Mounted in the plenum and generally centered on the sidewall 21*a* of the oven enclosure is an electric motor 27 which drives a centrifugal wheel 28 disposed within the scroll or housing 29, the discharge of the centrifugal wheel being indicated at 31**. It will be understood that this discharge or exhaust fitting may accommodate suitable flexible tubing which conveys the exhaust from the fan to the outside of the home or enclosure in which the range is located.

Figure 4:
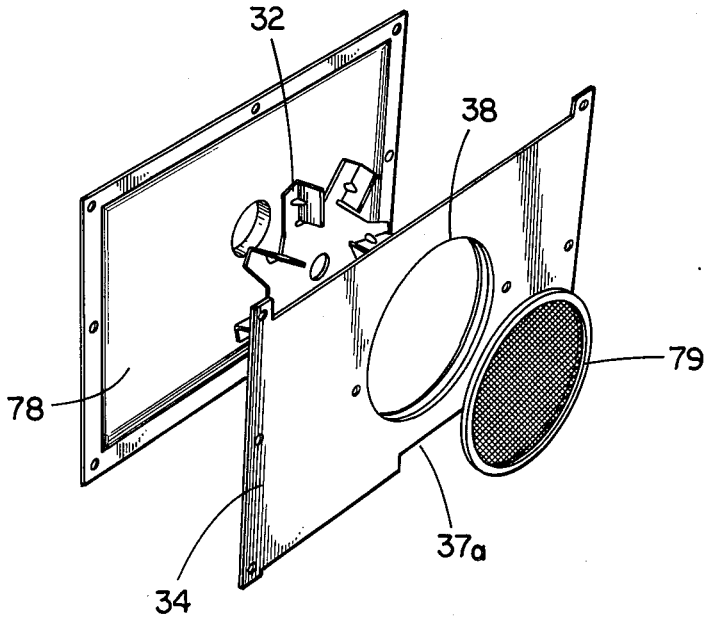
FIG. 4 is a perspective, exploded view of a further portion of a oven assembly of FIG. 3.

As may be seen in FIG. 1, the motor shaft, opposite its attachment to the centrifugal wheel 28, is extended through an opening 30 in the oven sidewall **21*a* and carries a centrifugal fan 32 which will subsequently be described in further detail with reference to FIG. 4. Inset in the insulation layer 22 is a dished plate 78 which provides a space 33 within which the fan 32 rotates, the plate 78 thus serving as a fan housing. The plate 34 forms the right hand (as viewed in FIG. 1) boundary of the space 33 and is provided with marginal upper and lower outlet slots 36 and 37 formed by cutting away a portion of the upper and lower marginal areas of the plate 34 as shown in detail in FIG. 4**. As will be evident from FIGS. 2 and 4, the rear portion of the lower margin of the plate is cut away somewhat more deeply as indicated at 37*a*. As will be evident from FIG. 1, these slots 36 and 37 form the discharge openings for the fan 32, the intake for the fan being formed by the central, circular opening 38 in the plate 34. As will subsequently be explained the circulation of air within the oven caused by the operation of the fan 32 will sweep past the conventional upper or broil oven element 41 and the lower or baking element 42. Conventionally located within the oven at the upper end of the plenum 23 and adjacent its intake 24 there is provided a series of slots 23*a* which are shown in detail in FIG. 5. As may best be seen in FIG. 2, it should be noted that the burner box 51 which conventionally underlies the surface element 10 which is positioned above the oven 11 is spaced somewhat from the upper margin of the adjacent insulating layer 22 to form a passage 52. As may be seen in FIGS. 1 and 2 the rearwall 14 and the sidewall 13 which are adjacent the oven enclosure 21 may be slotted as indicated at 53 and 54 to permit the entry of air from the exterior of the range into the passage 52 from whence it is drawn through the slots 23*a* into the plenum.

Referring to FIG. 7 it will be noted that the oven door 19 is provided along its lower margin with a series of slots 56 and along its upper margin a series of slots 57. As previously mentioned, and as will be evident from FIG. 2, the interior of the door is hollow so that cooling air may enter the slot 56 and move upwardly to exit through the slots 57. This upward air flow through the door 19 is induced, not solely by convection, but by the sub-atmospheric pressure in the passage 52 caused by operation of the air moving means 28. Cooling air exiting through the slots 57 in the door is drawn through slots 58 which extend through the front panel 17 of the oven at the base of the overhang 17*a* as shown in FIG. 2. The slots 58 are closely adjacent the slots 57 when the door 19 is closed but are spaced somewhat therefrom and are in general registration or alignment with the slots 57.

Figure 6:
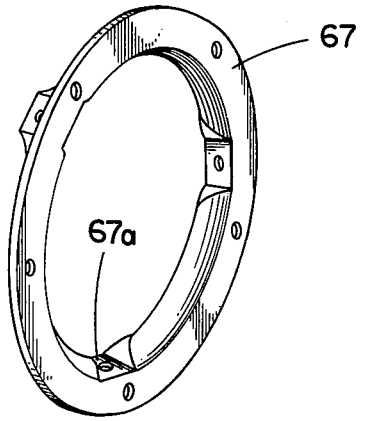
FIG. 6 is a perspective view of the motor mounting ring.
Figure 5:
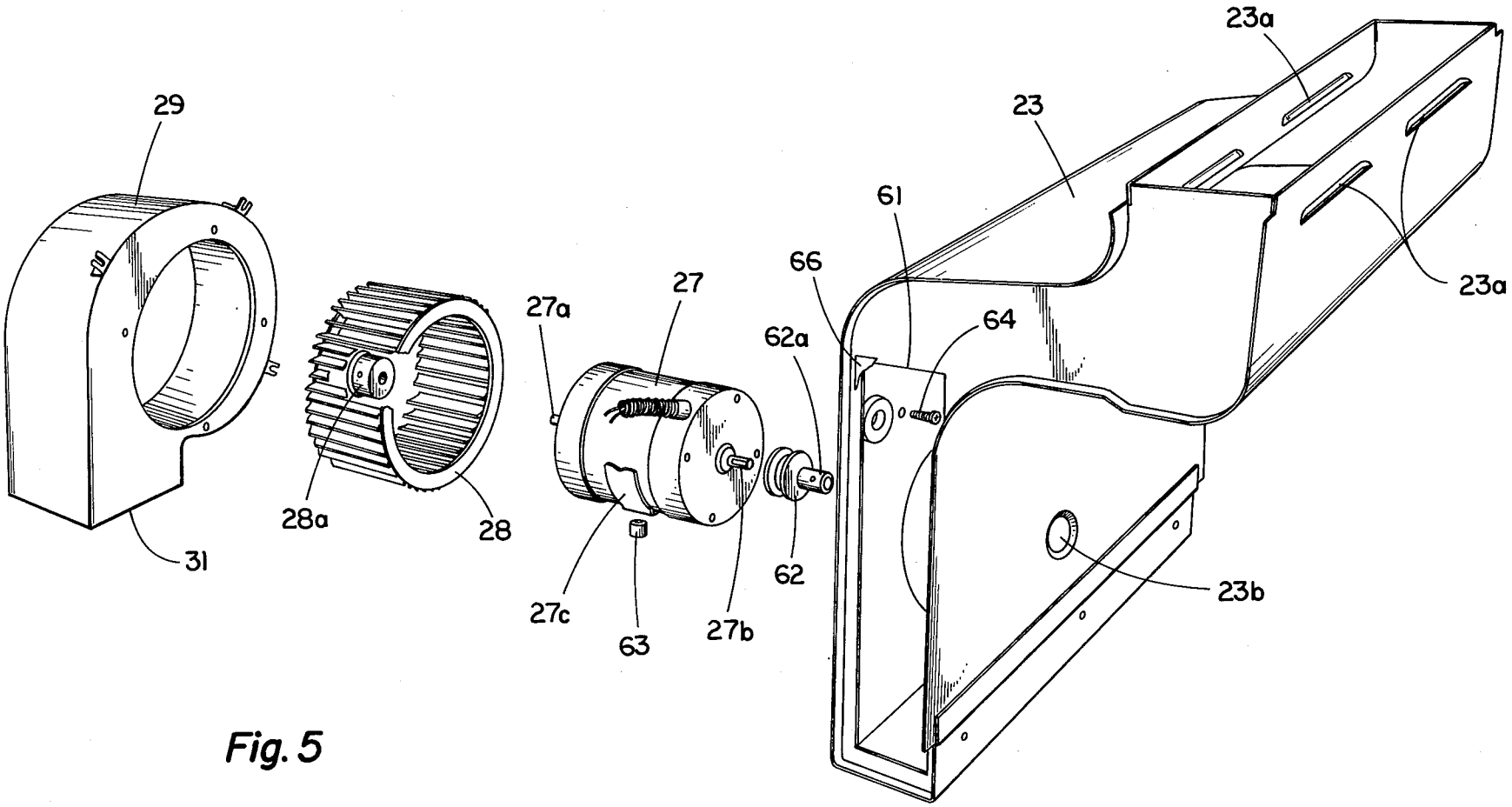
FIG. 5 is an exploded, perspective view of the plenum and cooperating air moving components of the structures shown in FIGS. 1 and 2.

Referring to FIG. 5, it will be noted that the housing 29 of the blower wheel 28 is attached to the face of the member 23 forming the plenum by means of bolts 61. The leftward extension (as viewed in FIG. 5) 27*a* of the motor shaft is received in the hub 28*a* of the blower wheel. The rightward extension 27*b* of the motor shaft receives a heat sink fitting 62, the extending shank of which, identified at 62*a* receives the hub of the centrifugal fan 32 of FIG. 4. The shank 62*a* of the fitting 62 extends through the aperture 23*b* in the sidewall of the plenum member 23, the fan 32 carried on the fitting being disposed within the adjacent enclosure formed in the oven sidewall as shown in FIG. 1. The motor 27 is mounted by means of a ring 27*c* and three spaced members 63, only a portion of the ring being shown in FIG. 5. A rectangular opening 64, providing access to the interior of the plenum, is normally closed by the removable cover plate 66, only a fragment of which is shown in FIG. 5. A mounting ring 67, as shown in FIG. 6, is received in the axial opening in the housing 29 and the three embossed portions 67*a* of the ring 67 (FIG. 6) accommodate the resilient spacers 63 and function to provide the three-point support for the motor 27, the spacers also providing air flow space around the motor.

Figure 3:
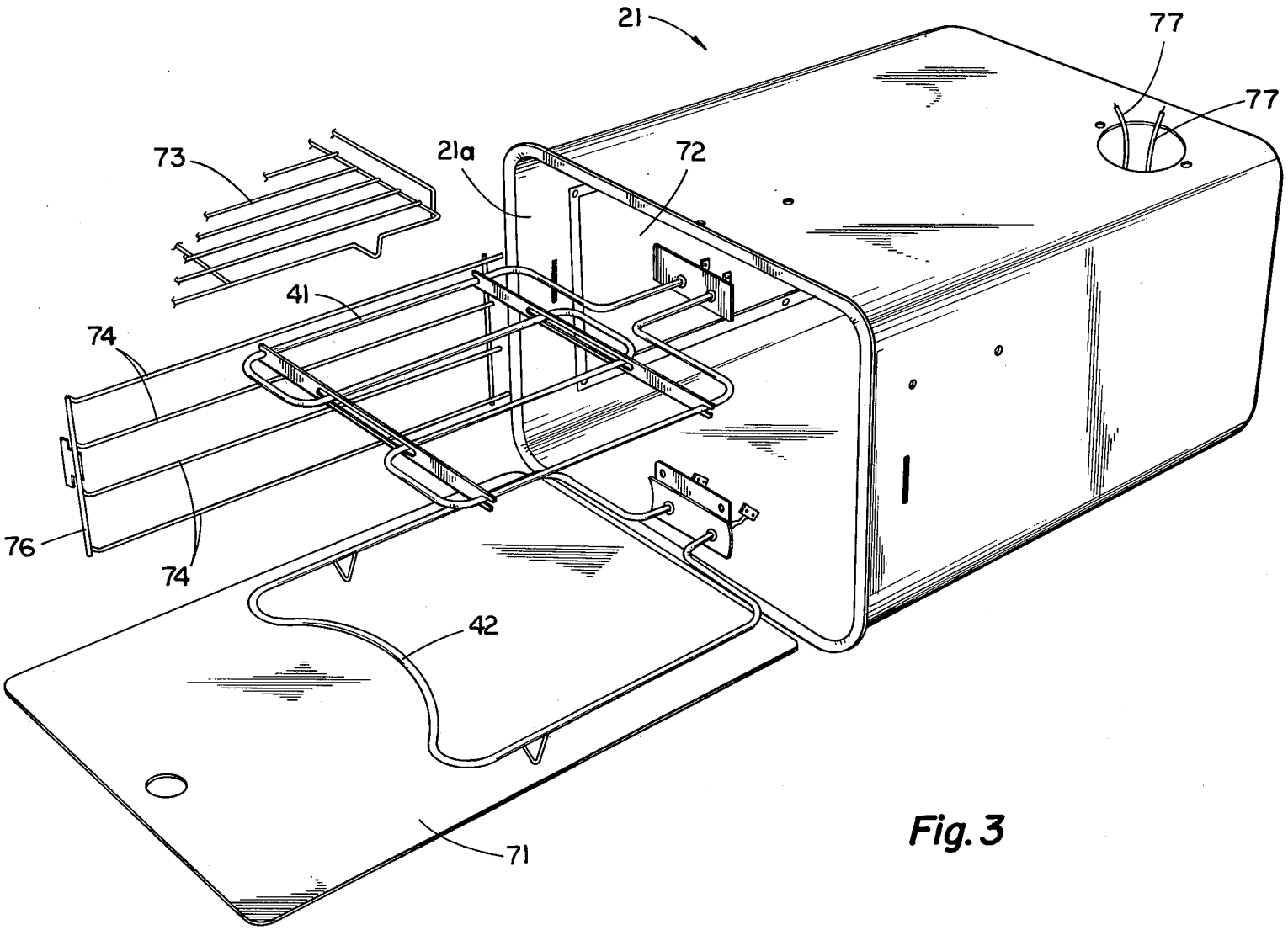
FIG. 3 is an exploded, perspective view of the oven component shown in FIG. 1.

Referring to FIG. 3, the oven is shown in further detail. The oven structure is composed of a generally rectangular box which receives in conventional fashion the upper or broil electrical heating element 41 which may be of the sheathed type. The conventional lower or baking heating element 42 is accommodated in the oven spaced slightly above the oven base. A drip tray 71 is slidable into and out of the oven and underlies the heating element 42. The wall 21*a* of the oven has a rectangular cutout portion 72. A conventional oven rack 73 may be inserted in the oven the rack being selectively positionable on the horizontal rails 74 of the side members 76, one of the members 76 being disposed on each side of the oven, only one, however, being shown in FIG. 3. Wire leads 77 by proper connection (not shown) serve to energize the conventional internal oven lamp (not shown).

It will be understood that the dished plate 78 (FIG. 4) overlies the opening 72 (FIG. 3) in the oven sidewall and, together with plate 34 (FIG. 4) forms the enclosed space 33 (FIG. 1) within which the fan 32. As may be seen in FIG. 4, the intake opening 38 in the plate 34 may be provided with a removable filter element 79.

In operation, the air moving means formed by the motor 27 and the blower 28 will draw fumes arising from food cooking on the surface elements into the intake 24 and will exhaust the fumes to the outside through the exhaust fitting 31 in conventional fashion. If the oven is to be utilized in the conventional mode, with the surface elements off the motor 27 will not be energized and conventional baking may proceed utilizing the lower heating element 42 in the oven, or conventional radiant broiling may be accomplished by utilizing the upper oven heating element 41. The oven, in this radiant heating mode of operation may thus be utilized in conventional, domestic oven fashion.

If the oven is to be used in the convected mode, by proper setting of the control one or both of the elements 41 and 42 may be energized together with the air moving means embodied in motor 27 and the centrifugal fan 32. As may be seen in FIG. 1, with the fan 32 in operation the discharge of the fan will be channeled through the slots 36 and 37, with the current of air passing across and adjacent to the upper and lower heating elements 41 and 42, the return path for the air moving through the opening 38 to the fan. As the air circulation arrows in FIG. 1 indicate, this provides a substantially closed circulation of air in the oven transferring the heat from the elements 41 and 42 to the food in the oven by means of this forced circulation. This forced circulation heat transfer within the oven occurs without additional heating elements in the oven other than the conventional upper and lower units 41 and 42. A single motor drives both the blower wheel 28 and the fan 32.

As previously mentioned, the interior of the oven may be coated with a porcelain compound containing catalytic material which functions to oxidize grease and food particles reaching the oven walls when the oven is heated. This catalytic coating for the oven interior is known in the prior art, however, the oven construction of the range construction of the present invention provides enhanced cleaning effect for this compound because of the elevated temperature to which the oven may be safely subjected, this being made possible by a cooling air circulation over certain of the oven surfaces. The controls for the oven may be provided with a setting for a cleaning cycle of the oven, the temperature setting being of the order of 550° F and the controls may be integrated with proper timing apparatus to automatically halt the elevated temperature operation of the oven after the passage of a predetermined time interval, for example, three hours. Again referring to FIG. 2, with the air moving means in operation cooling air will be drawn through the apertures 56 and the base of the oven door, will proceed upwardly through the door to exit through the apertures 57 in the oven door and will enter the passage 52 through the apertures 58 at the base of the over-hang portion of the oven front panel 17. This air flow will move across the upper, front surface of the oven and be drawn through the slots 23*a* into the plenum to eventually exit through the exhaust 31. Additional cooling air will be drawn through the slots 54 (FIG. 1) and 53 (FIG. 2) into the chamber 52 and through the slots 23*a*. It will be understood that operation of the air moving means is continued during the elevated temperature, cleaning cycle operation of the oven. The cooling effect of the air circulation just described within the interior of the oven door and over the adjacent oven surfaces permits operating the oven at the relatively high temperature which makes the catalytic cleaning feature far more effective than would be the case if the oven were operated at conventional, lower oven temperatures.

Figure 8:
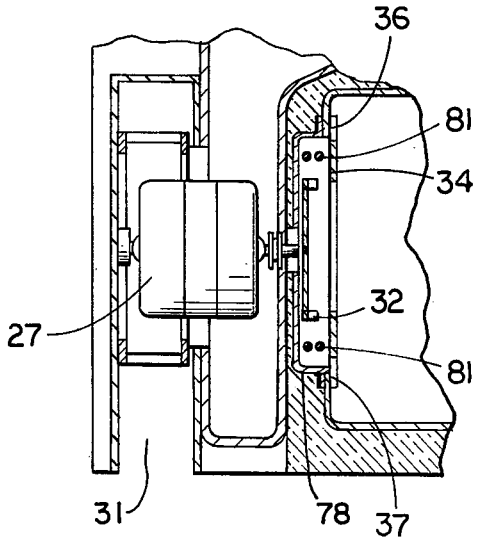
FIG. 8 is a fragmentary, side sectional view similar to FIG. 1 but illustrating a modified form of the structure.

Referring to FIG. 8, there is shown a modified form of the range structure which is a duplicate of the structure shown in FIG. 1 except that the circular, sheathed heating elements 81 are supported in encircling relation to the fan 32. The heating element 81 is disposed within the enclosure fronted by plate 34 and in the discharge path of air from a fan 32 prior to the exit of the air through the slots 36 and 37. The addition of the heating element 81 provides an alternative method of heating the air circulated within the oven when operated in the convection mode and offers the possibility of providing this heated air circulation without operation of the conventional upper and lower oven heating units.

While the invention has been disclosed and described in some detail in the drawings and foregoing description, they are to be considered as illustrative and not restrictive in character, as other modifications within the scope of the invention may readily suggest themselves to persons skilled in the art.

We claim:

1. A range having ventilated surface cooking units and an oven operable in either a radiant mode or a convected mode and utilizing a first air moving means for providing ventilation of the surface units and a second air moving means for providing the convection air circulation in the oven, said range including a range housing supporting electrical surface cooking units and an oven enclosure having thermally insulated walls and having conventional upper and lower electrical heating elements therein, said oven enclosure being disposed below said surface units and having a frontal opening and an oven door for closing said opening, means forming an air plenum chamber along one sidewall of said oven enclosure and extending between an intake aperture adjacent the surface units and a discharge aperture adjacent the range housing base, said first air moving means being disposed in said plenum chamber, a housing inset in said one oven enclosure sidewall for accommodating said second air moving means, means for mounting said second air moving means including a switch-controlled electrical drive motor mounted in said plenum chamber, a drive shaft extending from said motor through said one oven sidewall into said inset housing and supporting said second air moving means therein, said inset housing having an intake aperture communicating with the oven interior and an exhaust aperture adjacent each of said conventional upper and lower oven heating elements, whereby operation of said second air moving means provides forced circulation of air within said oven, the circulating air being heated by said conventional oven heating elements.

2. A range as claimed in claim 1 in which said second air moving means takes the form of a fan disposed in said inset housing, and said inset housing includes a plate overlying said fan having openings therein providing the intake and discharge apertures for the fan and directing fan induced air flow over said heating elements in the oven enclosure.

3. A range as claimed in claim 2 in which said fan discharge apertures comprise elongated horizontal slots in said plate disposed adjacent to said upper and lower heating elements in the oven enclosure.

4. A range as claimed in claim 3 in which said intake aperture for said fan is disposed intermediately between said discharge apertures.

5. A range as claimed in claim 1 in which each of said air moving means includes a rotating impeller carried on opposite end portions of a unitary drive shaft extending from opposite ends of said electric motor.

* * * * *